United States Patent [19]

Ruigrok

[11] Patent Number: 4,610,109

[45] Date of Patent: Sep. 9, 1986

[54] GATE

[75] Inventor: Franciscus B. M. Ruigrok, Son, Netherlands

[73] Assignee: Heras Holding Company B.V., Oirschot, Netherlands

[21] Appl. No.: 614,807

[22] Filed: May 29, 1984

[30] Foreign Application Priority Data

Jun. 6, 1983 [NL] Netherlands ..... 8302007
Dec. 5, 1983 [EP] European Pat. Off. ..... 83201728.9

[51] Int. Cl.[4] ..... E05D 15/00
[52] U.S. Cl. ..... 49/381; 49/427
[58] Field of Search ..... 49/503, 427, 362, 131, 49/381, 56, 396

[56] References Cited

U.S. PATENT DOCUMENTS

| | | | |
|---|---|---|---|
| 1,465,443 | 8/1923 | Josler | 49/56 |
| 1,960,015 | 5/1934 | Kitzelman | 49/56 X |
| 3,089,267 | 5/1963 | Wooden | 49/131 |
| 4,000,590 | 1/1977 | Kordewick | 49/56 X |
| 4,283,881 | 8/1981 | Moore et al. | 49/503 X |

*Primary Examiner*—Kenneth Downey
*Attorney, Agent, or Firm*—John P. Snyder

[57] ABSTRACT

A gate for closing a passage comprising a support post and a gate hingedly mounted on the post, said gate comprising a horizontal girder supporting spaced vertically extending spikes, the means extending longitudinally through the girder, passing through all of the spikes, secured to opposite ends of the girder and subsequently tensioned thereby exerting sufficient compression in the girder to resist bending thereof and normally preventing the spikes from engaging the ground surface.

15 Claims, 8 Drawing Figures

Figure 4:
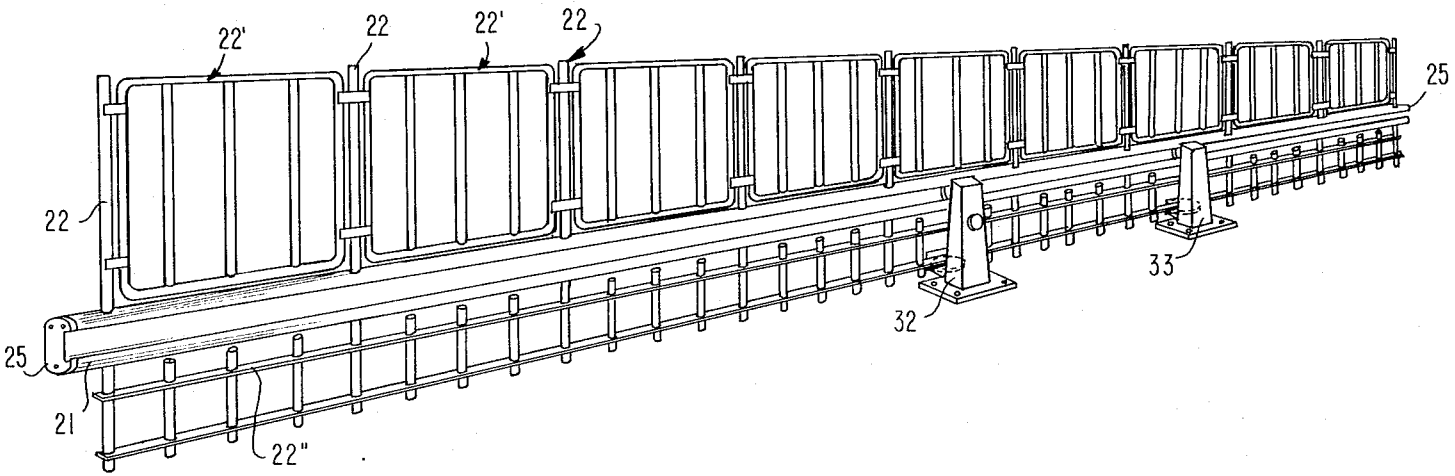

FIG. 1
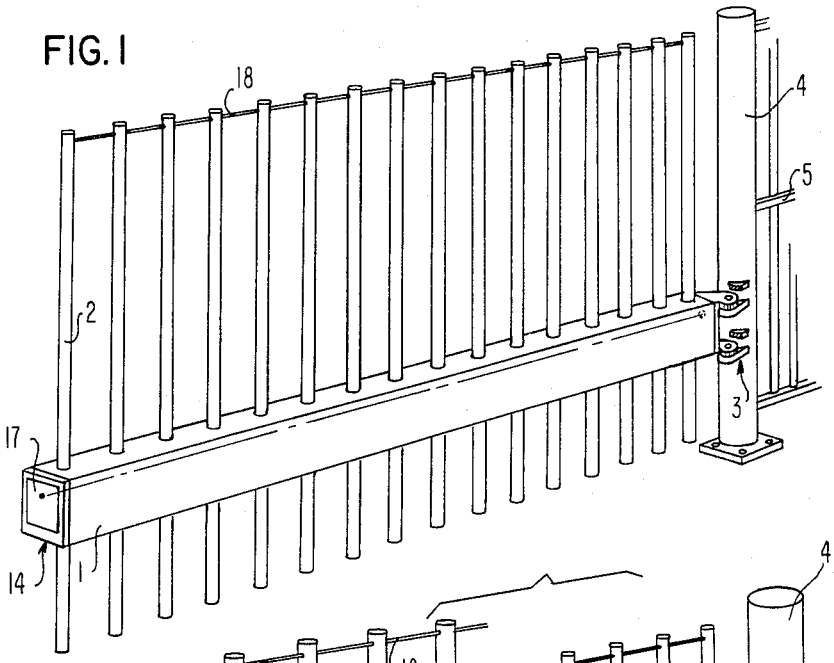
FIG. 2
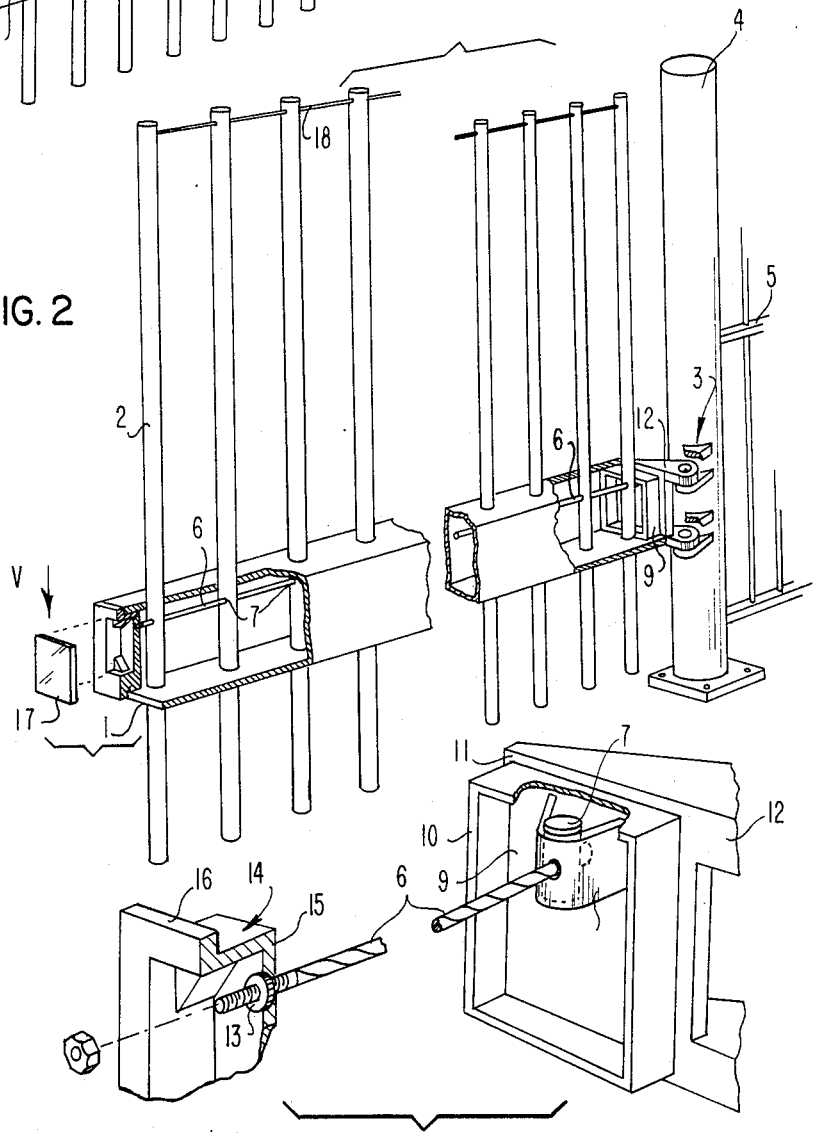
FIG. 3

FIG. 5
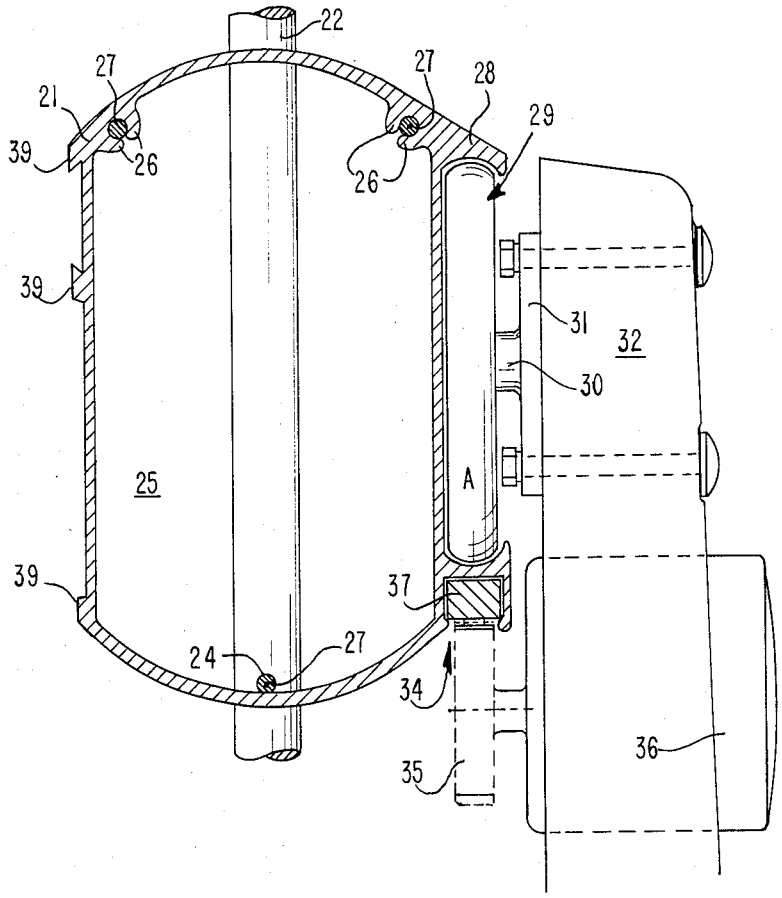
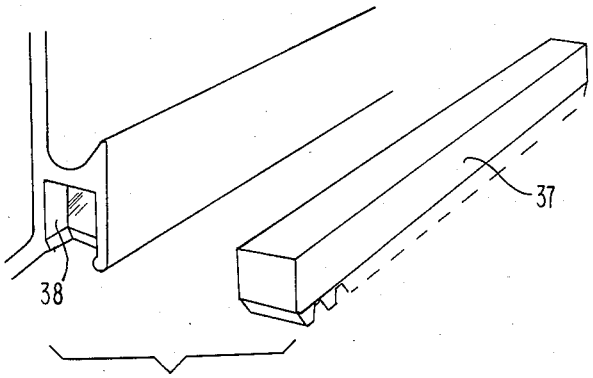
FIG.6

GATE

The invention relates to a gate for closing a passage mainly comprising at least one post and a part movable with respect to said post and being formed by a set of standing spikes interconnected by a transverse tie.

Gates of the type described above are generally formed by a rectangular framework, in which the spikes are arranged. Such frameworks must have sufficient rigidity to avoid deformations in the vertical plane. This requires, therefore, a relatively heavy structure with much material. A further inconvenience is that such a gate has to be fully finished in the factory and be then transported to the place of destination, which involves transport problems because of the maniability and the required transport place.

The invention has for its object to obviate the aforesaid disadvantages and provides to this end a gate which is distinguished in that the transverse tie is formed by a girder having at least two openings each of which can receive a spike and each spike being provided with connecting means to fasten it to the girder.

Since the construction is thus limited to practically one main girder and vertical spikes, it can be transpoted in the unmounted state, the final assembly being carried out at the place of use. The final assembly is relatively simple and additional welding operations may be rendered redundant. The component elements can be protected separately in the factory against corrosion due to weather conditions without this protection being deteriorated in the final assembly.

In a preferred embodiment as a tie means a single rod-shaped element is passed through all spikes and fastened at both ends to an anchoring member of the girder.

Preferably the girder is constructed in the form of a hollow profile, the clamping element being housed in the profile. Apart from an improvement in aesthetic appearance, a satisfactory protection of the clamping element is obtained.

In a further embodiment the anchoring element can be drawn against a head face of the girder, whilst the anchoring element carries a hinge part for the hinge to be fastened to the post. By this embodiment a turngate can be obtained which is distinguished from conventional turngates in that now a vertical load on the girder results in that the girder is urged downwards, the prestressing element absorbing the forces, said element moving the girder again upwards when the load is obviated. In this way a very "flexible" gate construction is obtained, whilst the hinge remains free of load.

In a further embodiment the girder is provided with a guide rail for a guide member an at least one post, for example, a roller, a sliding piece or the like.

In this way a sliding gate can be obtained with simple means.

According to the invention the girder may have an open hollow profile capable of accommodating toothed rack parts so that the teeth protrude out of the profile. By this step the length of the toothed rack serving for sliding the gate to and fro by a motor can be readily adapted to the length of the girder.

The above mentioned and further features will become apparent from the following description of the figures showing a few embodiments.

Figure 7:
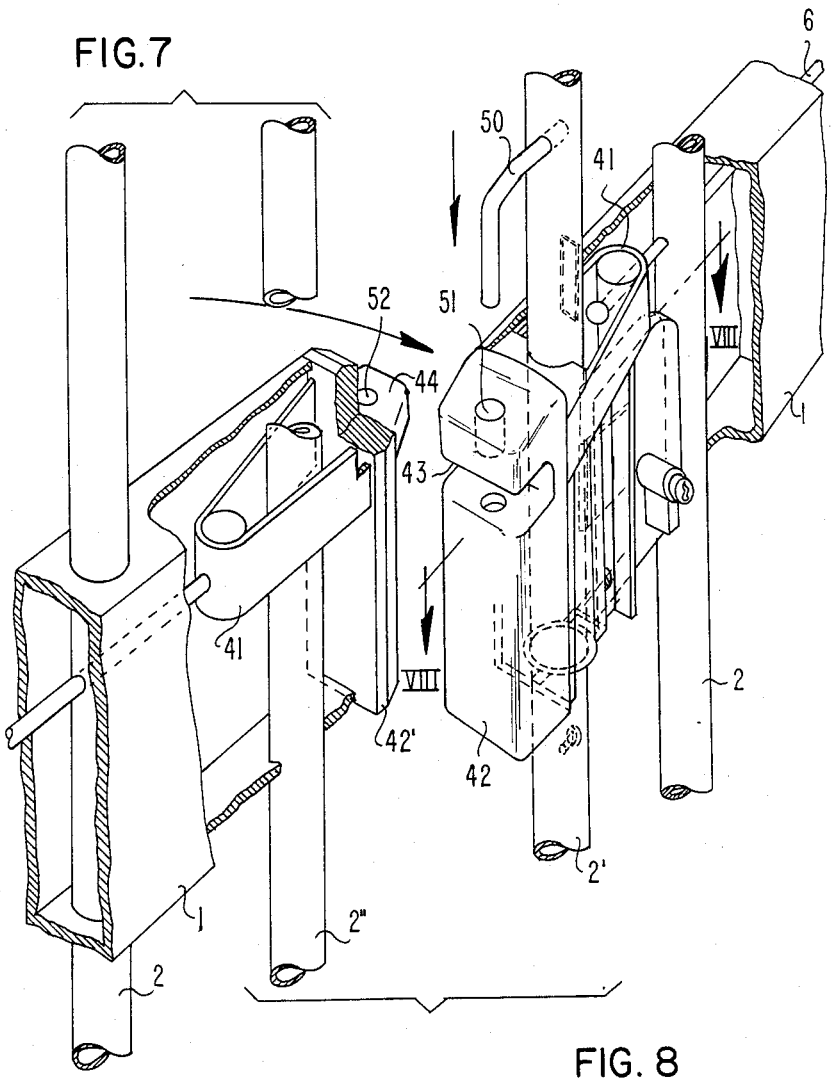
Figure 8:
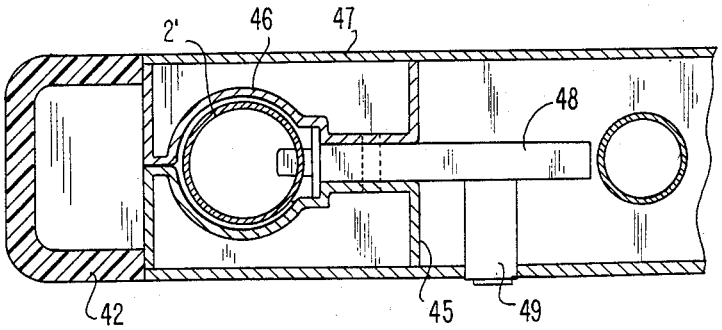

The drawing shows in:

FIG. 1 a perspective view of a turngate enbodying the invention,

FIG. 2 a perspective view of the turngate of FIG. 1 on an enlarged scale, FIG. 3 a perspective view of the stretching element used in the turngate of FIG. 1, FIG. 4 a perspective view of a sliding gate embodying the invention, FIG. 5 a cross-sectional view of a girder used in the sliding gate of FIG. 4, FIG. 6 a perspective view of part of the profile of FIG. 7, FIG. 7 a perspective view of a closing member in a double turngate, FIG. 8 a sectional gate taken on the line VIII—VIII in FIG. 7.

Referring to FIGS. 1 to 3 the swing gate mainly comprises a horizontal girder 1 provided with a sequence of continual holes in the direction of length, each of which can receive spikes 2 in a vertical sense. The girder is fastened at one end to a pivot 3 carried by a post 4 at the side of the passage. To the post 4 can be joined railings in known manner.

The horizontal girder 1 is formed by a hollow profile (see FIG. 2) having the sequence of holes for receiving the spikes 2 in the upper and lower faces. In the hollow profile is arranged a fastening element formed by a clamping wire or rod 6, which is passed through transverse holes 7 of each spike 2. One end of the clamping rod 6 is provided with a head part or knob 7, which fits in a saddle support 8. The support 8 is fastened to a head plate 9 having a circumferential ridge 10 which slidably fits in the hollow profile 1, the head face of the hollow profile 1 bearing on a projecting rim part 11. The plate 9 with the circumferential ring 10 and the rim part 11 is fastened to a pivot wing 12.

The other end of the clamping element or rod 6 is provided with clamping means 13, which bear on an end part 14, whose shaft 15 also fits inside the hollow profile 1 and whose collar 16 bears on the head face of the hollow profile. The shaft 15 is depressed so that the clamping means 13 are located completely inside the end part 14. The opening of the shaft 15 can be closed by a lid 17.

The gate described above is assemblied as follows.

It is assumed that all component parts have to be assembled at the place of use. The profile 1 is first provided with spikes 2 by passing them through the sequence of holes of the profile. The spikes 2 are arranged in the profile 1 in a manner such that the continuous holes 7 are approximately registering, after which the clamping element 6 can be passed through the holes 7. Then one end, which may already be provided with a knob 7, is deposited in the saddle support 8 of the end part 9, after which the rim 10 is slipped into the profile 1. Subsequently the other end of the element 6 is passed through the hole concerned of the end part 14, after which the rod can be tightened by means of, for example, any clamping means, say the nut 13 shown screwed onto a screwthread end of the rod 6. After the desired prestress is attained in the element 6 a guard but can be mounted.

Finally the girder 1 with the pivot wing 12 tightened thereto can be suspended to the co-operating pivot parts of the hinge 3 of the post 4. The lid 17 closes the opening of the end part 14.

From the foregoing it will be apparent that mounting the gate embodying the invention can be carried out in an extremely simple manner. The further advantage obtained by the swing gate described above in that in the case of a vertical load in the direction of the arrow V (see FIG. 2) the free end of the girder 1 can move down to an extent such that the lower end of the outermost spike touches the ground. This only results in a slight prolongation of the clamping element 6, in which case the girder 1 can turn with respect to the pivot wing 12, since the profile shifts in place with respect to the rim 10. When the load is eliminated the clamping element 6 will again push the girder upwards so that the gate resumes its initial position. In this way not only simple mounting of the gate but also a "flexible" gate is obtained, which in the event of excess load does not cause deformation of the hinge, whilst after the load the gate resumes its former shape. It will furthermore be obvious that the location of the spikes 2 with respect to the girder 1 is accurately determined by the location of the transverse holes 7 and the claiming element 6 so that the spikes 2 remain at the correct height.

For completeness' sake it is noted that the top ends of the spikes can be interconnected by any clamping rod or wire 18. In the case of large vertical dimensions it is furthermore possible to arrange two girders one above the other. Preferably the lower girder is located approximately at the average bumper lever of verhicles so that in the case of a collision the forces exerted on the gate are absorbed by the girder 1.

FIGS. 4 to 6 show a further embodiment i.e. sliding gate. This sliding gate is also provided with a horizontal girder 21, which has a plurality a through-holes each of which can receive a spike 22. Between the spikes 22 prefabricated trellis work 22' and 22'' can be fastened at any desired place. Mounting and fastening of the spikes 22 are carried out as described above. Each spike has a transverse hole 23 through which a clamping element 24 can be passed. The clamping element 24 is fastened at both ends, as described above, to head elements 25 and it can be prestressed in the same way.

It should be noted that the clamping element 24 is not arranged in the upper part of the hollow girder 21, but in the lower part thereof, whilst the hollow girder is furthermore provided with guide ridges 26 in which additional clamping elements 27 are arranged. These clamping elements 27 are fastened, like the clamping element 24, to the head parts 25. The latter clamping elements 27 contribute to the rigidity of the girder 21, which is particularly important with large spans of, for example, 15 meters. The profile 21 of FIG. 5 is provided on one side with guide means 28 formed by an upper and a lower ridge having a convex inner surface capable of receiving a roller 29. The roller 29 is rotatably journalled around the axis A—A about a stub shaft 30 having a flange 31 for being fastened to a post 32 or 33 respectively. The posts 32 and 33 spaced apart by a given distance and it will be obvious that when the gate is shifted the profile 21 can roll to and fro along the posts 32 and 33 because the rollers 29 can roll along the guide profile 28.

The reciprocatory sliding movement of the gate can be obtained by means of a toothed rack-pinion system 34, the pinion 35 being driven by a motor 36 fastened to the post 32.

According to a feature of the invention the toothed rack 37 of the toothed transmission 34 is formed here by elements 37' of fixed length. These elements having, for example, a length of 1 meter, are slipped into a hollow profile 38, which is open is downward direction until the profile 38 is filled throughout its length. A redundant part of the toothed rack element 37' can be sawed off so that in a simple manner the desired lengths can be obtained. Also in the case of the above-mentioned tooth rack transmission 34 a simple mounting can be ensured because only the outermost toothed rack elements 37' need be fixed in the profile 38. This fixation may take place in any way, for example, by welding. It is preferred to enclose these elements 37' between the head elements 25.

It should furthermore be noted that the side of the hollow profile 21 remote from the guide profile 28 may be provided with ridges 39 on which supports or other members such as handles can be arranged.

With both types of suspended gates described above one of the ends of the girder may be provided with a locking element as shown in FIGS. 7 and 8. The same parts of the gate are designated by the same reference numerals. The embodiment of FIG. 7 is a double gate, each gate part being capable of turning about its own post. Each gate part again comprises a hollow girder 1 with spikes 2 standing vertically therein and being connectable in the girder 1 by means of the clamping element 6. On the side not shown this clamping element is fastened to an anchoring member arranged near the hinge side of the gate part, whereas the other end of the clamping element 6 is anchored in a bracket 41 of a lock element 42 and 42' respectively. The two lock elements are complementary i.e. one element has a recess 43 and the other element has a tongue 44 fitting in said recess.

The lock element 42 of the right-hand gate part of FIG. 7 is furthermore provided with a guide piece 45 fitting in the girder 1, in which a circular guide 46 is provided for the outermost spike 2'. This spike 2' is not fastened by means of the clamping element 6, but it can be moved up and down in the guide 46. At a suitable place the spike 2' has a recess adapted to receive the bolt 47 of a locking mechanism 48. The bolt has a length such that it can be largely passed into the guide 46. The locking mechanism 48 comprises a cylinder lock 49 accessible from the outside.

The spike 2' is furthermore provided with a downwardly directed pin 50 (see FIG. 7) which in the lowermost position of the spike 2' drops onto a hole 51 of the lock element 42 and into a hole 52 of the tongue 44 of the lock element 42'.

It will be obvious that interlocking the gate parts can take place in a simple manner by directing the gate parts so that the tongue 44 snaps into the recess 43, after which the spike 2' moves down so that after insertion of the bolt 47 and locking by means of the cylinder lock 49 the closure is established.

For completeness' sake it is noted that also the end spike of the other gate part, on the left hand in FIG. 7, can be vertically slidable in the girder 1, whilst the two spikes 2' and 2'', in the closing position or the open position respectively, can be deposited on the ground or in a cavity thereof so that a locking relative to the ground can be established. The invention is not limited to the embodiments described above. For example, the shape of the spikes 22 may be arbitrary, for example, curved inwardly and/or outwardly on the top side. The spikes may have a tip and adjacent spikes may be fastened to one another by bending.

The continuous hole in the girder 21 need not strictly be vertical, it may also be inclined so that the spikes 22 are in inclined positions both in the plane normal to the girder 21 and in the direction of length thereof.

The outermost spikes 22 may be provided on the underside with ground wheels or skids. The girder 21 need not have the form of a hollow profile; it may have any transverse profile and it may be solid.

What is claimed is:

1. A gate assembly comprising the combination of an elongate girder adapted to be disposed in generally horizontal position above the ground surface and a plurality of upstanding pickets carried by said girder; supporting means for movably supporting said girder from a post to form a gate; a first member at one end of said girder; and prestressing means for placing said girder under longitudinal compression, said prestressing means including a second member at that end of said girder opposite said one end thereof and at least one tension member within said girder and anchored between said first member and said second member, and means for maintaining said tension member under longitudinal tension to compress said girder between said first member and said second member.

2. A gate assembly as defined in claim 1 wherein said girder is provided with a series of openings along its length and said pickets extend through said openings, said pickets having alinged transverse openings within said girder and said tension member passing through the openings in said pickets.

3. A gate assembly as defined in claim 1 or 2 including a generally vertical supporting post and hinge means for swingably attaching said girder to said post, said hinge means including said first member.

4. A gate assembly as defined in claim 1 or 2 including a pair of generally vertical supporting posts and means for slidably supporting said girder from said posts.

5. A gate assembly as defined in claim 3 including a second girder and a second generally vertical supporting post and second hinge means for swingably attaching said second girder to said second post for movement into end-aligned relation to the first mentioned girder, said second girder carrying vertically slidable picket means for latching the aligned ends of the two girders together.

6. A gate assembly comprising the combination of an elongate generally horizontal girder adapted to be moved between open and closed positions, post means supporting said girder in elevated relation to ground surface for movement of the gate assembly between its open and closed positions such that a portion of the length of the girder is unsupported and may bend downwardly due to vertically downwardly directed forces exerted thereon, a plurality of generally upstanding pickets carried by said girder and projecting downwardly therefrom at least in the region of the unsupported portion of the girder to limit force-induced bending of the girder, and flexible tension means for exerting sufficient longitudinal compression in said girder as to resist said bending thereof and normally prevent said pickets from engaging the ground surface.

7. A gate assembly as defined in claim 6 wherein said tension means holds said pickets relative to said girder.

8. A gate assembly comprising an elongate girder adpated to be disposed in generally horizontal, elevated position and a plurality of upstanding pickets carried by said girder, support post means for supporting said girder to move between open and closed positions, and at least one flexible tension element passing longitudinally through said girder and anchored in tensioned condition adjacent the opposite ends of the girder to exert longitudinal compression on said girder.

9. A gate assembly as defined in claim 8 including a first end plate member seated against one end of the girder and a second end plate member seated against the opposite end of the girder, said flexible tension element being anchored to said first and second end plate members.

10. A gate assembly as defined in claim 9 wherein said support post means is hinged to said first end plate member so that downward bending of the girder tends to separate said first end plate member from its associated end of the girder to exert increased tension in said flexible tension element.

11. A gate assembly as defined in any of the claims 8–10 wherein said pickets pass through said girder and are provided with aligned openings therewithin, said flexible tension element passing through said aligned openings to connect said pickets to said girder.

12. A gate as claimed in claim 8, characterized in that the girder has a guide rail for guiding a guide member mounted on at least one post, for example, a roller, a sliding piece or the like.

13. A gate as claimed in claim 12 characterized in that the guide rail forms part of the girder constructed in the form of a profile.

14. A gate as claimed in claim 13, characterized in that the girder has a gutter profile adpated to receive toothed rack parts so that the teeth of these parts point out of the profile.

15. A gate as claimed in claim 14, characterized in that the girder is provided on the outer side with longitudinal ridges for accomodating auxiliary elements such as indicating boards, handles and the like.

* * * * *